US008746839B2

(12) United States Patent
Hayashi

(10) Patent No.: US 8,746,839 B2
(45) Date of Patent: Jun. 10, 2014

(54) FLUID EJECTION APPARATUS

(75) Inventor: Takato Hayashi, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 639 days.

(21) Appl. No.: 12/706,275

(22) Filed: Feb. 16, 2010

(65) Prior Publication Data

US 2010/0207994 A1 Aug. 19, 2010

(30) Foreign Application Priority Data

Feb. 17, 2009 (JP) ..... 2009-033593

(51) Int. Cl.
*B41J 2/165* (2006.01)

(52) U.S. Cl.
USPC ..... 347/32

(58) Field of Classification Search
None
See application file for complete search history.

(56) References Cited

U.S. PATENT DOCUMENTS

| | | | | |
|---|---|---|---|---|
| 7,213,904 | B2 * | 5/2007 | Miyauchi | 347/33 |
| 2006/0244780 | A1 * | 11/2006 | Hsieh | 347/33 |
| 2008/0218553 | A1 | 9/2008 | Ito | |

FOREIGN PATENT DOCUMENTS

| | | |
|---|---|---|
| EP | 0860283 | 8/1998 |
| JP | 07-032611 | 2/1995 |

* cited by examiner

*Primary Examiner* — Alejandro Valencia
(74) *Attorney, Agent, or Firm* — Workman Nydegger

(57) ABSTRACT

A fluid ejection apparatus ejects a fluid from a nozzle and includes a nozzle opening surface in which the nozzle is formed. A fluid removal unit removes fluid adhering to the nozzle opening surface. The fluid removal unit includes a plate-shaped wiper member that is formed from an elastic material. The wiper member moves from one end of the nozzle opening surface to the other as the ejection head or the wiper member moves while in a state where the wiper member makes contact with the nozzle opening surface and elastically deforms. A splash catching member is erected in front of the wiper member when the wiper member moving relative along the nozzle opening surface separates from the nozzle opening surface and returns to its original shape. The splash catching member catches objects that had been adhering to the nozzle opening surface and are scattered by the wiper member.

5 Claims, 4 Drawing Sheets

FLUID EJECTION APPARATUS

This application claims the benefit of Japanese Patent Application No. 2009-033593, filed Feb. 17, 2009, which is expressly incorporated herein by reference in its entirety.

BACKGROUND

1. Technical Field

The present invention relates to a technique for ejecting a fluid onto an ejection target medium.

2. Related Art

Ink jet printers print images by ejecting ink onto a print medium. Because the locations in which ink is ejected, the ejection amount, and so on can be controlled with an extremely high level of precision, high-quality images can be printed. Fluid ejection apparatuses that form various types of functional components, such as electrodes, sensors, and the like, by ejecting fluids containing various types of functional materials onto a substrate have also been proposed.

Fluid ejection apparatuses such as ink jet printers and the like include an ejection head provided with multiple nozzles, and eject a fluid such as ink onto an ejection target medium (for example, a print sheet) by ejecting the fluid from the nozzles while changing the relative position between the ejection head and the ejection target medium. If a foreign object adheres to a nozzle opening surface formed in the ejection head in a position facing the ejection target medium, there is a risk that the foreign object will obstruct the ejection of the fluid. Accordingly, the stable ejection of the fluid is facilitated by using a plate-shaped member formed from an elastic material such as silicon rubber (a wiper member) to remove the foreign object that has adhered to the nozzle opening surface. Note that the operation for using such a wiper member to remove objects adhering to the nozzle opening surface is called "wiping".

During wiping, the wiper member is in an elastically deformed state due to the nozzle opening surface. The elastically deformed wiper member thus forcefully attempts to return to its original shape after the wiping has ended, and if the objects that adhered to the nozzle opening surface and were removed are scattered as a result, there is a risk that the surrounding area will be soiled thereby. Accordingly, a technique that attempts to avoid soiling the surrounding area by suppressing the force with which the wiper member returns to its original shape has been proposed (JP-A-07-032611).

However, there is a problem with the stated proposed technique in that soiling the surrounding area due to the objects that adhered to the nozzle opening surface being scattered during removal cannot be completely avoided. That is, even if the force with which the wiper member returns to its original shape is suppressed, the wiper member nevertheless attempts to return under its own elastic force, and thus the objects that adhered to the nozzle opening surface may still be scattered at that time. Accordingly, there is a problem in that a situation in which the surrounding area is soiled by adhering objects that have been scattered cannot be completely prevented.

SUMMARY

An advantage of some aspects of the invention is to provide a technique that enables the complete elimination of the risk that a surrounding area will be soiled by scattered adhering objects that were removed from a nozzle opening surface by the wiper member.

In order to solve at least part of the problem mentioned above, a fluid ejection apparatus according to an aspect of the invention adopts the following configuration. That is, the apparatus is a fluid ejection apparatus that ejects a fluid from a nozzle provided in an ejection head, and includes: a nozzle opening surface in which the nozzle is provided; and a fluid removal unit that removes fluid adhering to the nozzle opening surface. The fluid removal unit has: an approximately plate-shaped wiper member formed from an elastic material; a relative movement unit that causes the wiper member to move relative to the nozzle opening surface from one end of the nozzle opening surface to the other end of the nozzle opening surface by causing at least one of the ejection head and the wiper member to move while in a state where the wiper member makes contact with the nozzle opening surface and elastically deforms; and a splash catching member, having an approximate plate shape, that is erected in front of the wiper member when the wiper member moving relative along the nozzle opening surface separates from the nozzle opening surface and returns to its original shape, the splash catching member catching objects that had been adhering to the nozzle opening surface and that are scattered by the wiper member.

With the fluid ejection apparatus according to this aspect of the invention, at least one of the ejection head and the wiper member is caused to move while in a state where the wiper member makes contact with the nozzle opening surface, and thus it is possible to remove objects that have adhered to the nozzle opening surface. In addition, when the wiper member separates from the nozzle opening surface and returns to its original shape, the approximately plate-shaped splash catching member is erected in front of the wiper member (in a direction in which the wiper member relatively moves to reach a point for separating from the nozzle opening surface); accordingly, even if objects that had been adhering to the nozzle opening surface are scattered from the wiper member, those objects can be caught.

In order to effectively remove objects that adhere to the nozzle opening surface, it is necessary to bring the wiper member into contact with the nozzle opening surface and cause the wiper member to deform. As a result, when the wiper member separates from the nozzle opening surface, the wiper member will inevitably return to its original shape. As long as the wiper member returning to its original shape is inevitable, it is extremely difficult to completely prevent the wiper member from scattering objects adhering thereto at that time. However, if the objects scattered by the wiper member are caught instead, erecting the splash catching member in front of the wiper member makes it possible to catch the entirety of the splash. Accordingly, it is possible to easily and completely prevent the surrounding area from being soiled by objects removed from the nozzle opening surface and scattered by the wiper member.

In addition, according to another aspect of the invention, the splash catching member in the fluid ejecting apparatus may be provided in a position adjacent to the wiper member. The splash catching member may enter a withdrawn state in which the splash catching member does not interfere with the nozzle opening surface in a stage before the wiper member makes contact with the nozzle opening surface, and may then return to the erect state in front of the wiper member in a stage before the wiper member separates from the nozzle opening surface.

Providing the splash catching member adjacent to the wiper member in this manner makes it possible to process the objects caught by the splash catching member collectively along with the objects removed by the wiper member.

According to another aspect of the invention, the fluid ejection apparatus may be configured as follows. First, the splash catching member is configured of a retractable member. The splash catching member may enter the state in which it is withdrawn from the nozzle opening surface by tilting upon making contact with the ejection head before the wiper member makes contact with the ejection head, and may then return to the erect state in front of the wiper member by separating from the ejection head before the wiper member separates from the nozzle opening surface.

If an attempt is made to withdraw the splash catching member by sliding the splash catching member when withdrawing the splash catching member to a position in which it does not interfere with the nozzle opening surface, an actuator that drives the splash catching member is required to perform a stroke having the same amount of movement as the splash catching member. As opposed to this, if the splash catching member is withdrawn by tilting the splash catching member, the tip portion of the splash catching member experiences a large amount of movement even if the splash catching member is withdrawn by only a small rotational angle. Accordingly, tilting the splash catching member rather than sliding the splash catching member makes it easier to withdraw the splash catching member to a position in which the splash catching member does not interfere with the nozzle opening surface.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described according to the following order in order to clarify the content of the invention.

A. Apparatus Configuration

B. Wiping Mechanism

A. Apparatus Configuration

Figure 1:
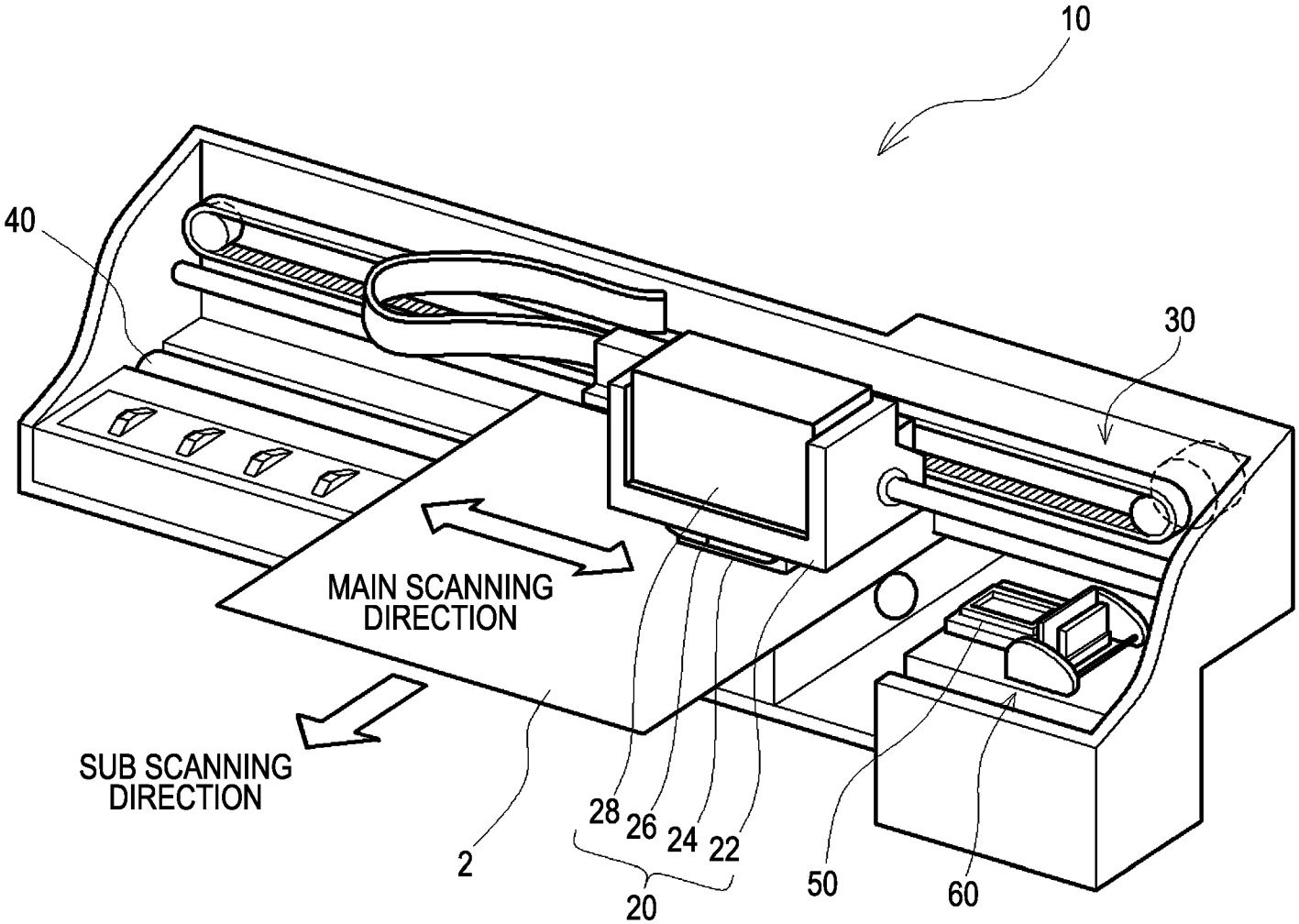
FIG. 1 is a descriptive diagram illustrating the general configuration of a fluid ejection apparatus according to an embodiment of the invention, using an ink jet printer as an example.

FIG. 1 is a descriptive diagram illustrating the general configuration of a fluid ejection apparatus according to an embodiment of the invention, using what is known as an ink jet printer as an example. As shown in FIG. 1, an ink jet printer 10 is configured of: a carriage 20 that forms ink dots upon a print medium 2 while moving back and forth in the main scanning direction; a driving mechanism 30 that moves the carriage 20 back and forth; a paper transport roller 40 for transporting the print medium 2; a cap 50 in which a rubber material is formed in a concave shape; a wiping mechanism 60 for removing foreign objects such as ink that have adhered to the bottom surface of the carriage 20 (the side of the carriage 20 that faces the print medium 2); and so on.

Of these, the carriage 20 is provided with an ink cartridge 28 that holds ink, a carriage case 22 in which the ink cartridge 28 is installed, and so on, and an ejection head 24 for ejecting ink droplets is provided on the bottom surface of the carriage case 22. The ink within the ink cartridge 28 is supplied to the ejection head 24, and an appropriate amount thereof is ejected onto the print medium 2. Furthermore, guide rails 26, mentioned later, that protrude on both sides of the ejection head 24 are provided on the bottom surface of the carriage case 22. The guide rails 26 will be described later with reference to another drawing.

The ejection head 24 is provided with multiple nozzles for ejecting ink, but if foreign objects such as ink, dust, or the like adhere to a nozzle opening surface into which these nozzles open, the ink cannot be ejected in an appropriate manner. Accordingly, a wiping operation for wiping off foreign objects that have adhered to the nozzle opening surface is carried out by causing one of a wiper blade formed from an elastic material such as silicon rubber and the ejection head 24 to move relative to the other in a state in which the wiper blade is pressed against the nozzle opening surface. The wiping mechanism 60 is a mechanism for performing such a wiping operation. Meanwhile, if the wiper blade that is pressed against the nozzle opening surface returns to its original shape after the wiping operation has ended and scatters the foreign objects, such as ink, that have been wiped off of the nozzle opening surface, the surrounding area will be soiled. Accordingly, the wiping mechanism 60 according to this embodiment is provided with an ink guard (a splash catching member) for preventing foreign objects from the wiper blade from scattering into the surrounding area. The specific structure of the wiping mechanism 60 and the action by which foreign objects scattered by the wiper blade are guarded against will be described in detail later.

Meanwhile, the paper transport roller 40 is driven by a driving motor, a gear mechanism, and so on (not shown), and is capable of transporting the print medium 2 in the sub-scanning direction in predetermined increments.

Figure 2:
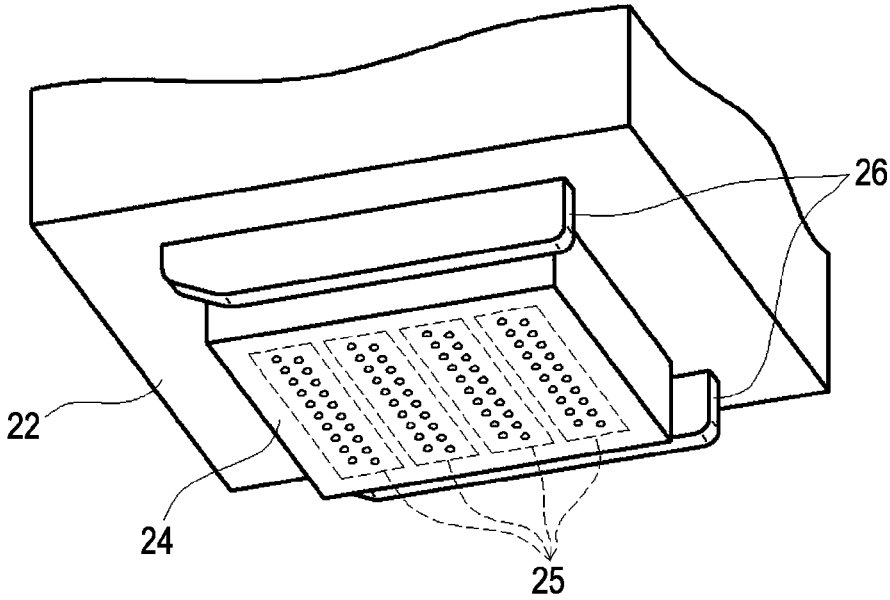
FIG. 2 is a perspective view illustrating a carriage case from the bottom surface thereof.

FIG. 2 is a perspective view illustrating the carriage case 22 from the bottom surface thereof. As shown in FIG. 2, the ejection head 24 is provided on the bottom surface of the carriage case 22, and multiple small nozzles for ejecting ink are open on the surface of the ejection head 24 that faces the print medium 2. These nozzles are provided in a state in which they are grouped by the color of the ink they eject. With the ink jet printer 10 according to this embodiment, four colors of ink, or black ink (K ink), cyan ink (C ink), magenta ink (M ink), and yellow ink (Y ink), are installed, and the nozzles are provided in a state in which they are roughly divided into four groups, or a nozzle group that ejects K ink, a nozzle group that ejects C ink, a nozzle group that ejects M ink, and a nozzle group that ejects Y ink. A nozzle opening surface 25 is formed for each of these nozzle groups.

Meanwhile, as shown in FIG. 2, plate-shaped guide rails 26 protrude on both sides of the ejection head 24. Although details will be provided later, with the ink jet printer 10 according to this embodiment, the ink guard is driven by using these guide rails 26 to partially depress the wiping mechanism 60. Hereinafter, the structure of the wiping mechanism 60 and operations of the wiping mechanism 60 according to this embodiment will be described in detail.

B. Wiping Mechanism

Figure 3:
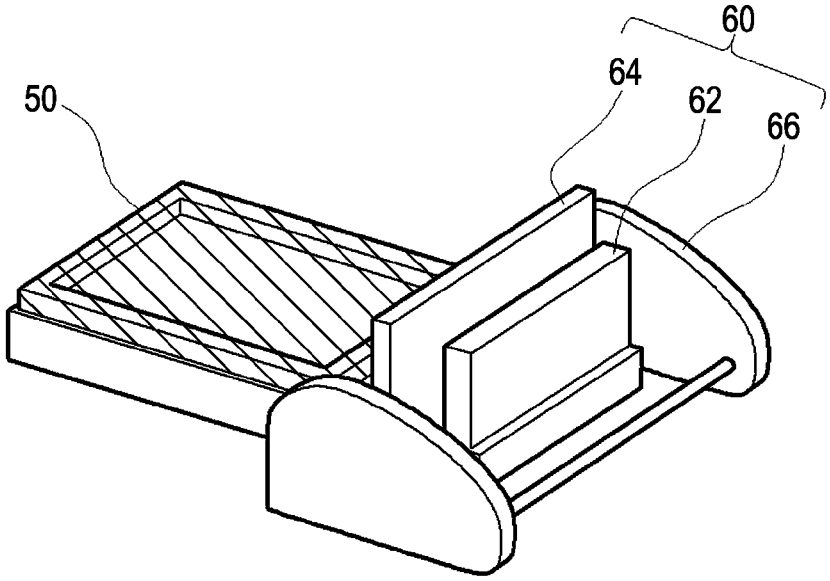
FIG. 3 is a perspective view illustrating the external shape of a wiping mechanism according to an embodiment of the invention.

FIG. 3 is a perspective view illustrating the external shape of the wiping mechanism 60 provided in the ink jet printer 10 according to this embodiment. As shown in FIG. 3, the wiping mechanism 60 according to this embodiment is configured of an approximately plate-shaped wiper blade 62, and approximately plate-shaped ink guard 64 provided approximately parallel to the wiper blade 62, a pair of guide cams 66 provided so as to sandwich the wiper blade 62 and the ink guard 64 on both sides thereof, and so on. Of these, the pair of guide cams 66 and the ink guard 64 are linked to each other, and the configuration is such that the ink guard 64 moves in correspondence with movement in which the guide cams 66 are depressed by the aforementioned guide rails 26. As opposed to this, the wiper blade 62 and the guide cams 66 do not move in correspondence with each other, and thus even if the guide cams 66 are depressed, the wiper blade 62 does not move as a result thereof. Furthermore, as shown in FIG. 3, the cap 50 is, when viewed from the wiper blade 62, provided on the far side of the ink guard 64, so that the ink guard 64 is located between the wiper blade 62 and the cap 50. In addition, the ink guard 64 is formed so as to be larger than the wiper blade 62 in terms of both width and height.

Figure 4:
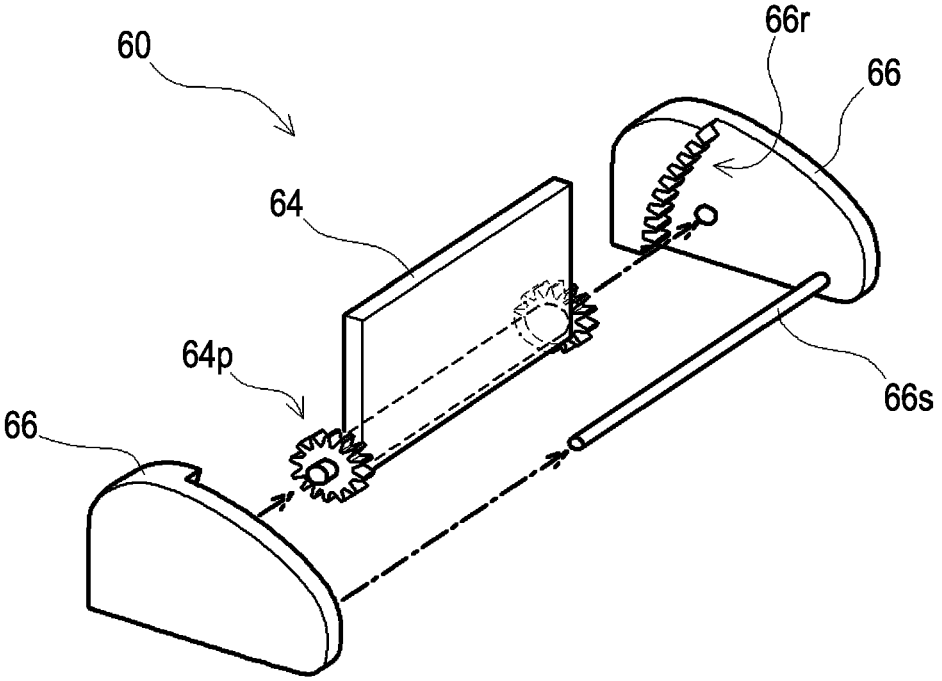
FIG. 4 is an exploded view of an ink guard and guide cams.

FIG. 4 is an exploded view of the ink guard 64 and the guide cams 66. The wiper blade 62 has been omitted from FIG. 4 in order to avoid complicating the drawing. As shown in FIG. 4, a shaft is formed in the bottom side of the ink guard 64, which is formed approximately as a plate shape, and small pinion gears 64*p* are fitted onto both sides of the shaft; thus the ink guard 64 and the pinion gears 64*p* are formed as a single integral component. Meanwhile, a thin shaft 66*s* is provided parallel to the shaft in the bottom side of the ink guard 64, and the pair of guide cams 66 is attached so as to sandwich the ink guard 64 and the shaft 66*s*. Furthermore, as shown in FIG. 4, a rack 66*r* is formed on the inner side of each guide cam 66, and what is known as a rack and pinion mechanism is thus configured by engaging the rack 66*r* with the pinion gears 64*p* of the ink guard 64.

Meanwhile, a cam surface is formed on the upper surface of the guide cams 66. When the cam surface is pushed by the guide rails 26 provided in the ejection head 24, the guide cams 66 rotate about the shaft 66*s* functioning as the rotational axis, and that movement is transmitted to the rack and pinion mechanism, causing the ink guard 64 to rotate and fall. Meanwhile, springs and stoppers (not shown) are also provided in the guide cams 66. Accordingly, the guide cams 66 are in the state shown in FIG. 3 when not being pressed by the guide rails 26, and rotate about the shaft 66*s* only when being depressed by the guide rails 26. Note that the wiper blade 62 is provided in the space between the shaft 66*s* and the ink guard 64, as shown in FIG. 3. Hereinafter, an operation by which the wiping mechanism 60 according to this embodiment, configured as described thus far, wipes away ink or the like that has adhered to the nozzle opening surface 25 of the ejection head 24 will be described.

Figure 5A:
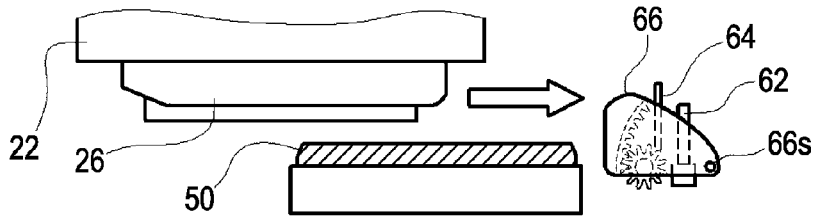
FIGS. 5A to 5E are descriptive diagrams illustrating a wiping operation performed by a wiping mechanism according to an embodiment of the invention.

FIGS. 5A to 5E are descriptive diagrams illustrating operations by which the wiping mechanism 60 according to this embodiment wipes away ink or the like that has adhered to the nozzle opening surface 25 of the ejection head 24 (a wiping operation). With the ink jet printer 10 according to this embodiment, the carriage case 22 is capable of moving in the sub scanning direction, but the cap 50, the wiping mechanism 60, and so on are in a fixed state. Accordingly, the wiping operation is carried out by moving the carriage case 22 toward the wiping mechanism 60. FIG. 5A illustrates a state in which the carriage case 22 is being moved in order to perform the wiping operation. Here, the guide rails 26 are provided protruding from the bottom surface of the carriage case 22, as described earlier using FIG. 2, and the guide cams 66 are provided in the wiping mechanism 60, as described earlier using FIG. 3. As shown in FIG. 5A, the guide rails 26 and the guide cams 66 are provided in positions in which they interfere with each other as the carriage case 22 approaches the guide cams 66. Accordingly, the guide rails 26 provided in the carriage case 22 ultimately depress the guide cams 66, causing the guide cams 66 to rotate about the shaft 66*s*.

Figure 5B:
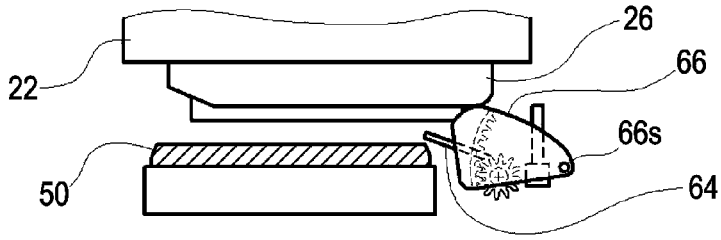

FIG. 5B illustrates a state in which the guide cams 66 have rotated about the shaft 66*s* as a result of being depressed by the guide rails 26. As shown in FIG. 4, a rack and pinion mechanism is formed between the guide cams 66 and the ink guard 64, and thus the rotational movement of the guide cams 66 is transmitted to the ink guard 64, causing the ink guard 64 to rotate so as to slant. The speed reduction ratio of the rack and pinion mechanism is set so that the rotation of the guide cams 66 is transmitted to the pinion gears 64*p* of the ink guard 64 in an accelerated state. Accordingly, the ink guard 64 experiences a large amount of rotation due to even a small amount of rotation by the guide cams 66, as shown in FIG. 5B. As a result of the ink guard 64 experiencing such a large amount of rotation, the tip of the ink guard 64 draws away to a position in which it will not interfere with the bottom surface of the ejection head 24.

Figure 5C:
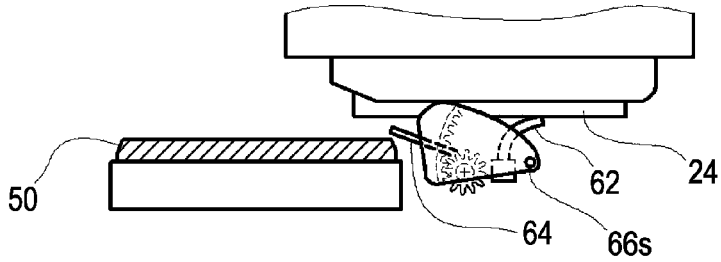

As shown in FIG. 5C, when the carriage case 22 is moved further with the guide rails 26 still depressing the guide cams 66 (with the tip of the ink guard 64 still drawn away as a result), the ejection head 24 makes contact with the wiper blade 62. To rephrase, the ink guard 64 is in a state in which it is drawn away from the ejection head 24 prior to the ejection head 24 making contact with the wiper blade 62. Meanwhile, as described earlier, the wiper blade 62 is formed from an elastic material such as silicon rubber or the like, and thus the wiper blade 62 deforms upon making contact with the ejection head 24. Accordingly, the wiper blade 62 is pressed against the nozzle opening surface 25 formed on the bottom surface of the ejection head 24 as a result of the movement of the carriage case 22, and when the carriage case 22 is moved in this state, foreign objects such as ink adhering to the nozzle opening surface 25 are wiped away by the wiper blade 62.

Figure 5D:
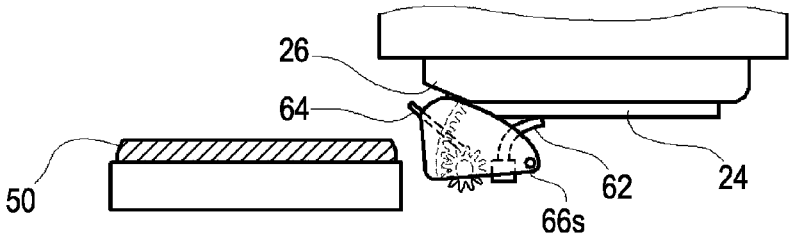

If the carriage case 22 continues to move while the wiper blade 62 wipes away foreign objects from the nozzle opening surface 25, the guide rails 26 will eventually pass, and as a result, the guide cams 66 will attempt to return to their original position. FIG. 5D illustrates a state in which the guide rails 26 have passed, and the guide cams 66 are beginning to return as a result thereof. As illustrated in FIG. 5D, when the guide cams 66 attempt to return to their original position, the ink guard 64, which has been drawn away, also attempts to return to its original position. Meanwhile, at this stage, the wiper blade 62 remains in a state in which it is pressed against the nozzle opening surface 25. To rephrase, the ink guard 64 begins to return to its original position at a stage in which the wiper blade 62 is still pressed against the nozzle opening surface 25.

Figure 5E:
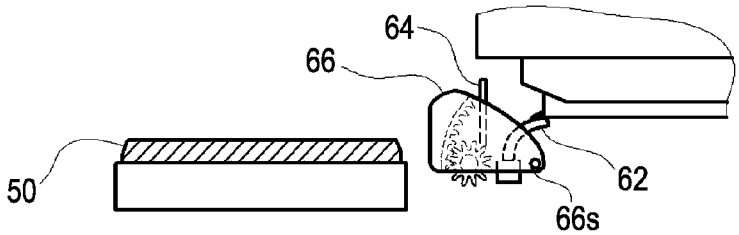

FIG. 5E illustrates a state occurring immediately before the wiper blade 62 leaves the nozzle opening surface 25 and returns to its original position. At this stage, the ink guard 64 is already in an upright state. Accordingly, even if the wiper blade 62, which has been pressed against the nozzle opening surface 25 and has been deformed as a result, forcefully returns to its original position and scatters the ink and the like wiped off from the nozzle opening surface 25 at that time, the ink guard 64, which has already returned to its upright state, can guard against this scattering. It is therefore possible to completely remove the risk of the other portions of the ink jet printer 10 being soiled. Further descriptions on this point will be provided hereinafter.

In the wiping operation, it is of course necessary for the wiper blade 62 to be in a state in which it is pressed against the nozzle opening surface 25. Naturally, as a result, it is difficult to avoid the wiper blade 62 that has been deformed from returning to its original shape after the wiping operation has ended. If the force by which the wiper blade 62 attempts to return to its original shape is suppressed, it is possible to suppress the ink and the like wiped from the nozzle opening surface 25 from scattering. However, unless the wiper blade 62 is completely suppressed from returning, simply suppressing the force by which the wiper blade 62 attempts to return merely reduces the amount of scattering, and thus it is not possible to completely eliminate the scattering. Accordingly, rather than preventing the wiper blade 62 from scattering ink, this embodiment ensures that the surrounding area will not be soiled even if ink is scattered. As described above, as long as the wiper blade 62 deforms, it is not possible to completely prevent ink from scattering; however, if the scattered ink is prevented from soiling the surrounding area, the same effect can be realized to its full extent. Accordingly, with the ink jet printer 10 according to this embodiment, the risk that ink that has been wiped off by the wiper blade 62 splashes back and soils the surrounding area can be completely eliminated.

Although a fluid ejection apparatus according to this embodiment has been described using the ink jet printer 10 as an example, the invention is not limited to the aforementioned embodiment or variations thereof; many other embodiments are possible without departing from the spirit of the invention.

The invention can be used in technology that ejects a fluid such as ink onto a medium such as a print sheet.

What is claimed is:

1. A fluid ejection apparatus that ejects a fluid from a nozzle provided in an ejection head, the apparatus comprising:

a nozzle opening surface in which the nozzle is provided; and a fluid removal unit that removes fluid adhering to the nozzle opening surface, wherein the fluid removal unit includes:

an approximately plate-shaped wiper member formed from an elastic material;

a relative movement unit that causes the wiper member to move relative to the nozzle opening surface from one end of the nozzle opening surface to the other end of the nozzle opening surface by causing at least one of the ejection head and the wiper member to move while in a state where the wiper member makes contact with the nozzle opening surface and elastically deforms; and a splash catching member, having an approximate plate shape, that is erected in front of the wiper member when the wiper member moving relative along the nozzle opening surface separates from the nozzle opening surface and returns to its original shape, the splash catching member catching objects that had been adhering to the nozzle opening surface and that are scattered by the wiper member, and a guide part that is connected to the splash catching member such that the ejecting head depresses the guide part to cause the splash catching member to enter a withdrawn state in which the splash catching member does not interfere with the nozzle opening surface in the stage before the wiper member makes contact with the nozzle opening surface.

2. The fluid ejection apparatus according to claim 1, wherein the splash catching member, which is a retractable member, enters the withdrawn state by tilting to a direction that goes away from the wiper member upon the contact of the fluid removal unit with the ejection head before the wiper member makes contact with the ejection head, and returns to the erect state by the separation of the fluid removal unit from the ejection head before the wiper member separates from the nozzle opening surface.

3. The fluid ejection apparatus according to claim 1, further comprising:

two plate-shaped guide rails that protrude on both sides of the nozzle opening surface and run the length of the nozzle opening surface, wherein the nozzle opening surface is located on the ejection head, and wherein the fluid removal unit includes two guide cams as the guide part provided at both sides of the wiper member and the splash catching member, wherein the guide cams are connected to the splash catching member such that the two guide rails depress the two guide cams to cause the splash catching member to enter a withdrawn state in which the splash catching member does not interfere with the nozzle opening surface in the stage before the wiper member make contact with the nozzle opening surface.

4. The fluid ejection apparatus according to claim 1, wherein the splash catching member enters the withdrawn state in which the splash catching member does not interfere with the nozzle opening surface in a stage before the wiper member makes contact with the nozzle opening surface, and keeps the withdrawn state in a stage where the wiper member moves relative along the nozzle opening surface, and returns to an erect state in front of the wiper member in a stage before the wiper member separates from the nozzle opening surface.

5. The fluid ejection apparatus according to claim 1, wherein the splash catching member is formed to have a larger width and height than the wiper member so as to catch the objects that are scattered by the wiper member.

* * * * *